US007044058B2

(12) United States Patent
Richards

(10) Patent No.: US 7,044,058 B2
(45) Date of Patent: May 16, 2006

(54) AUTOMATIC MOTOR PHASE PRESETTING FOR A WEB PRINTING PRESS

(75) Inventor: John Sheridan Richards, Barrington, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 10/612,219

(22) Filed: Jul. 2, 2003

(65) Prior Publication Data

US 2005/0000380 A1 Jan. 6, 2005

(51) Int. Cl.
*B41F 1/34* (2006.01)
*B44I 13/56* (2006.01)
*B41L 3/02* (2006.01)

(52) U.S. Cl. ..... 101/485; 101/481; 101/226; 101/486

(58) Field of Classification Search ..... 101/485, 101/248, 486, 481, 226, 177, 142, 492, 211, 101/483, 181, 220; 226/31, 21
See application file for complete search history.

(56) References Cited

U.S. PATENT DOCUMENTS

| | | | | |
|---|---|---|---|---|
| 4,437,403 | A | 3/1984 | Greiner | 101/248 |
| 4,527,788 | A | 7/1985 | Masuda | 270/21.1 |
| 4,665,824 | A | 5/1987 | Greiner et al. | 101/492 |
| 4,694,749 | A * | 9/1987 | Takeuchi et al. | 101/492 |
| 4,872,407 | A * | 10/1989 | Banke | 101/389.1 |
| 5,058,500 | A | 10/1991 | Mizuno | 101/142 |
| 5,123,887 | A * | 6/1992 | Shimura | 493/34 |
| 5,289,770 | A | 3/1994 | Hern | 101/226 |
| 5,327,826 | A * | 7/1994 | Rodi | 101/181 |
| 5,394,223 | A * | 2/1995 | Hart et al. | 399/165 |
| 5,415,092 | A * | 5/1995 | Hern | 101/226 |
| 5,492,059 | A * | 2/1996 | Reichel | 101/375 |
| 5,546,859 | A | 8/1996 | Hern | 101/226 |
| 5,771,811 | A * | 6/1998 | Siler et al. | 101/486 |
| 5,806,430 | A * | 9/1998 | Rodi | 101/484 |
| 5,813,337 | A * | 9/1998 | Peters et al. | 101/228 |
| 5,816,165 | A * | 10/1998 | Huston | 101/490 |
| 5,909,235 | A * | 6/1999 | Folkins | 347/240 |
| 5,987,949 | A * | 11/1999 | Palmatier et al. | 72/17.3 |
| 6,165,732 | A * | 12/2000 | Korsmeyer et al. | 435/7.2 |
| 6,167,806 | B1 | 1/2001 | Chretinat et al. | 101/220 |
| 6,408,748 | B1 * | 6/2002 | Hajek et al. | 101/177 |
| 6,568,323 | B1 * | 5/2003 | Tokiwa | 101/227 |

(Continued)

FOREIGN PATENT DOCUMENTS

| | | |
|---|---|---|
| DE | 3339552 | 5/1985 |

(Continued)

OTHER PUBLICATIONS

Helmut Kipphan, Handbook of Print Media, 2001, p. 52.*

(Continued)

*Primary Examiner*—Andrew H. Hirshfeld
*Assistant Examiner*—Wasseem H. Hamdan
(74) *Attorney, Agent, or Firm*—Davidson, Davidson & Kappel, LLC

(57) ABSTRACT

A method for presetting motor phase in a web printing press includes providing a mark on a printing form, the mark being a function of a desired preset phase for a motor driving the printing form during printing. The mark is read using a sensor, the sensor having a sensor output. The phase of the motor is preset as a function of the sensor output. A printing form and web printing press are also provided.

17 Claims, 2 Drawing Sheets

U.S. PATENT DOCUMENTS

| | | | | |
|---|---|---|---|---|
| 6,591,746 | B1 * | 7/2003 | Siler | 101/171 |
| 6,601,506 | B1 * | 8/2003 | Dauer | 101/248 |
| 6,615,732 | B1 * | 9/2003 | Hunold et al. | 101/486 |
| 2002/0023560 | A1 * | 2/2002 | Siegl et al. | 101/248 |
| 2002/0029706 | A1 | 3/2002 | Dauer | 101/248 |
| 2003/0221573 | A1 * | 12/2003 | Leonhardt et al. | 101/463.1 |

FOREIGN PATENT DOCUMENTS

| | | |
|---|---|---|
| DE | 3602894 | 8/1987 |
| DE | 3908270 | 8/1997 |
| DE | 19856675 | 9/1999 |
| DE | 19832892 | 1/2000 |
| DE | 10110640 | 10/2001 |
| EP | 0835753 | 4/1998 |
| EP | 0699524 | 10/2001 |
| EP | 0894624 | 11/2001 |
| EP | 1167035 | 1/2002 |
| EP | 1002646 | 3/2003 |
| GB | 2298985 | 9/1996 |
| JP | 2001158075 | 6/2001 |

OTHER PUBLICATIONS

U.S. Appl. No. 10/449,477; Filing Date May 29, 2003; Automatic Transmission of Data from Press-Press Stage to a Printing Press; Richards et al.

* cited by examiner

AUTOMATIC MOTOR PHASE PRESETTING FOR A WEB PRINTING PRESS

BACKGROUND INFORMATION

The present invention relates generally to printing presses and more specifically to the setting of a position of a motor in a printing press.

In a web printing press, the proper longitudinal positioning of the printed image on one web with respect to certain other printing press components, for example to a web cutting device, is required. To alter the longitudinal positioning of the printed image, the phase of a drive motor or motors for the printing units of one of the web may be altered so that the angle of the image on a cylinder with respect to the web is altered. An operator may run the printing press and through manual observation of the printed products alter the phase of the motors to obtain proper longitudinal positioning of each web. Alternately, marks on each web may be read by a sensor. A feedback loop may then be used to position the marks, and thus the webs, to a setpoint longitudinal position. A press operator may need to perform the manual observation or feedback correction each time the press is run.

U.S. Pat. No. 6,408,748 describes the setting the phase of a motor control in a web printing press using data sent directly by a computing and memory unit. This system requires a stable interface between the computing and memory unit and each motor control, and requires that the memory of the computing and memory unit remain persistent and accessible.

European Patent Application 1 167 035 discloses a synchronous control system having automatic cutting and printing registering functions based on the detection of predetermined marks for different colors in a rotary press using a paper web.

U.S. Pat. Nos. 5,289,770, 5,425,092 and 5,546,859 relate to a device for presetting a cut-off register in a folder of a web-fed printing press using a marking deice for applying a mark in an image free region between two printed images of a web.

U.S. Pat. No. 4,665,824 describes a job strip encoding printing process data on an indicia-free zone of an associated printing plate. The printing process data includes presetting or preadjustment values for ink adjustment devices, sheet feed information, format adjustment of the sheet feed, adjustment of side lays, front lays, bands or tapes and other characteristics associated with a sheet-fed printing press.

European Patent No. 1 002 646 discloses printing plate mounting position instruction system. Information marked on the printing plate in the form of, for example, a bar code is read in order or to determine in which position to mount a printing plate.

U.S. Pat. No. 5,058,500 discloses printing plates having an identification mark which indicates for which color the printing plate is and in which printing press the printing plate is to be used.

BRIEF SUMMARY OF THE INVENTION

An object of the present invention is to provide for direct setup of printing unit motor phasing without the need for a persistently accessible memory or database, manual intervention, or printed mark feedback loops.

The present invention provides a method for presetting motor phase in a web printing press comprising the steps of:

providing a mark on a printing form, the mark being a function of a desired preset phase for a motor driving the printing form during printing;

reading the mark using a sensor, the sensor having a sensor output; and presetting the phase of the motor as a function of the sensor output.

By storing the preset phase information on the printing form, persistent access to local databases or memory is not required for the presetting, and correlation of the preset phase information with a specific printing form is easier. No feedback loop or manual intervention is needed.

The mark may be a simple analog mark, which for example through a physical position on the printing form indicates the desired phase for that printing form. The mark also may contain, through its form, specific preset phase information. For example digital information may be provided in the form of a bar code or other coded sequence. In this case, the mark may be located at the same physical position on each printing form. Alternately, the physical position of the digital information mark may provide the desired phase, and the digital information can provide other or redundant preset information.

The printing form preferably is a printing plate, such as a lithographic printing plate, but may be a directly-imaged printing form, either integral with or removable from an image cylinder.

The mark may be placed on the printing plate during a prepress platemaking process. For example, the preset phase information can be provided to a computer-to-platemaking device, which would then create the marks outside the image area of the printing plate. Preferably, the mark is located laterally to the side of the image area of the printing form.

The sensor may read the mark when the printing form is on the printing press, or if the printing form is not integral with the printing press, before placement of the printing form on the printing press.

Since one web passes through a synchronously or commonly driven printing group of printing units, for example four printing units, only one printing form of the group with the mark is required to preset the entire printing group. However, the preset phase information could be provided on more marks of more than one printing form in the group.

Preferably, the printing form is associated with one web, and a second printing form is provided with a second mark, the second mark being a function of a desired second preset phase for a second motor driving the second printing form. The second form is associated with a second web.

With the present invention, initial motor phase can be determined or refined through operator-experience for a particular job, and noted or stored in any manner and then provided to the plate or image making equipment. A newspaper press, for example, may be used to run several different jobs per day. Job1 may be to print one newspaper and Job2 another newspaper with a different format. Each job requires a certain desired position for each web with respect to the cutting cylinders of the folder, which typically provides a zero or other reference point. Job1 and Job2 may then be rerun on subsequent days, with the image areas changing. The format and desired positions for the various webs however remain constant for a specific job. Job1 thus may require that printing form A printing a first web have an angle of 23 degrees with respect to a cylinder zero, and printing form B printing a second web have an angle of 110 degrees. Job2 may require different angles. Thus every time the image forms are created for Job1, a mark can be written on printing form A indicating the desired angle of 23 degrees, and a mark can be written on printing form B indicating the desired angle of 110 degrees.

The method of the present invention thus may further include calculating the desired preset phase for a specific job. Once an operator has determined the proper angle for a job during an initialization phase, the sensor advantageously can be used to sense a preliminary mark and determine the angle of the mark. This data can then be used to preset the plates of the same job in the future. The job data can be stored on a disk or other memory storage, but advantageously need only be made available to the plate or image making equipment and need not be persistently available to the printing press itself.

The present invention also provides a printing form, the printing form including an image area and a mark, the mark providing preset motor phase information.

The present invention also provides a web printing press comprising a first printing group for printing a first web and having at least one first drive motor and at least one first printing form, the first printing form having a first mark providing first preset motor phase information for presetting the first drive motor, to a first preset phase. The printing press includes a first sensor for reading the first mark and a controller for determining the first preset motor phase information as a function of an output of the first sensor.

The web printing press may further include a folder having a cutting device for cutting the web into signatures, the first preset motor phase information being a function of a position of the cutting device. The web printing press also may include a second printing group for printing a second web and having at least one second drive motor and at least one second printing form, the second printing form having a second mark providing second preset motor phase information for presetting the second drive motor to a second preset phase.

The controller may control the first and second drive motors in a synchronous fashion, even though the drive motors are independent. The controller also can receive an input from the folder or other press components. The input for example can provide a zero or other reference position indicating the cut position of the webs. The desired print position for each web can be based on this reference position.

BRIEF DESCRIPTION OF THE DRAWINGS

The present invention will be further described with respect the following FIGS. in which.

DETAILED DESCRIPTION

Figure 1:
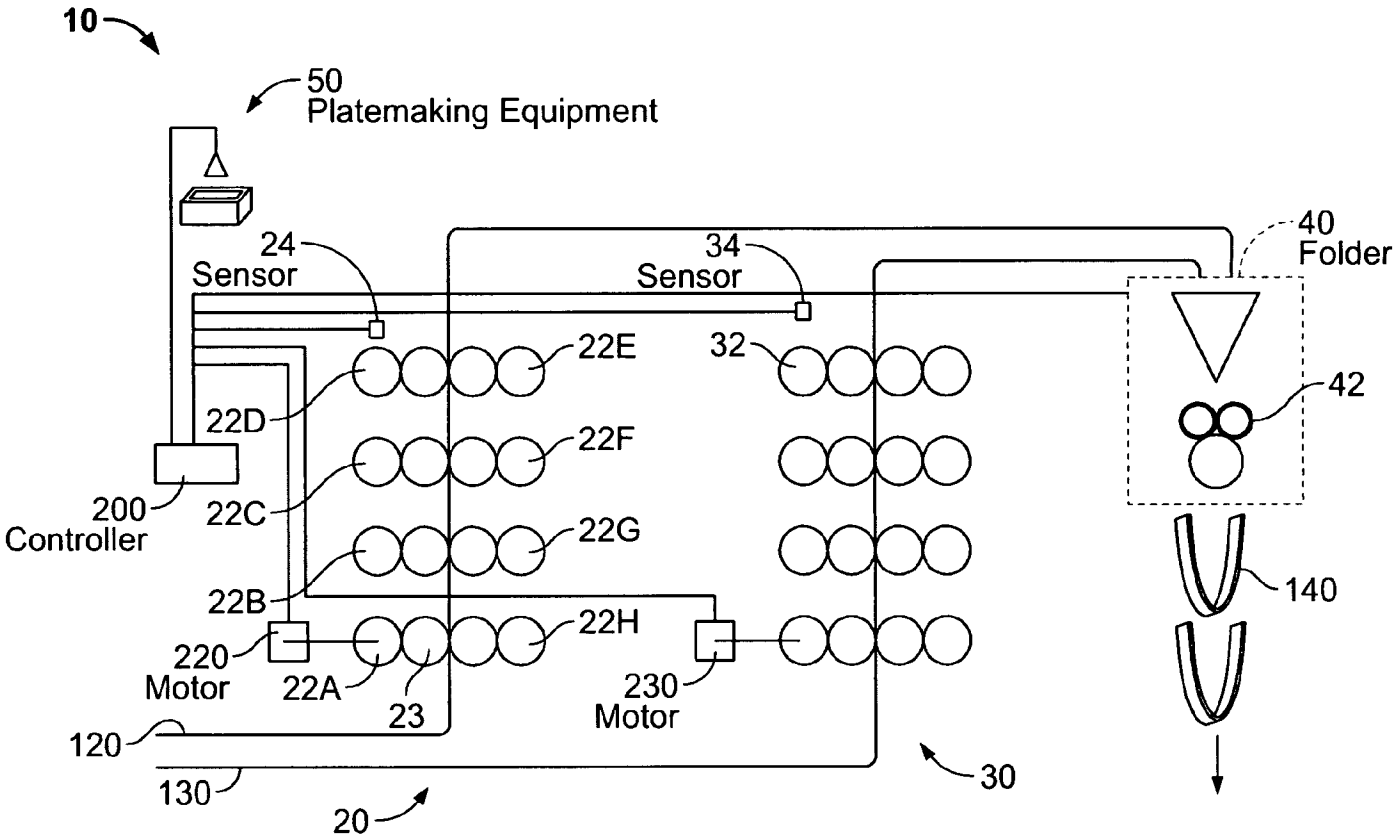
FIG. 1 shows schematically one embodiment of a web printing press according to the present invention with two printing groups and a folder.

FIG. 1 shows a printing press 10 having a first printing group 20 printing a first web 120 and a second printing group 30 printing a second web 130. A folder 40 folds webs 120, 130 and cuts the webs 120, 130 via a cutting device 42 into folded products 140, for example newspapers.

In this example, printing group 20 has eight plate cylinders 22A, 22B, 22C, 22D, 22E, 22F, 22G, 22H, each with an associated blanket cylinder 23. Each cylinder is driven directly or indirectly by a motor 220, although more than one motor may be provided for printing group 20, these motors then running synchronously. A second independent motor drives printing group 30. Instead of plates on plate cylinders, other printing forms, for example directly imaged cylinder surfaces, may be used.

A sensor 24 can read a mark on the plate for plate cylinder 22D, for example, and provide an input to a controller 200. Plate cylinder 22D has an encoder with a zero position, and when the plate cylinder 22D is rotated by the controller 200, through for example an operator command, the input can indicate the desired preset phase for the motor 220. The controller 200 thus can ensure that the web is disengaged from blanket cylinders 23, and rotate the motor 220 so that all plate cylinders 22A to 22H are in the proper angular position for the particular print job. The blanket cylinders 23 can then reengage the web 120. Alternately, the presetting can occur at the beginning of a print run while the press is being run and printed at a speed slow enough to avoid web tearing or overrunning. Thus "presetting" of the motor phase as defined herein can include altering the motor phase at the beginning of a print run while the press is being run or from a standstill position.

The same presetting procedure can occur for printing group 30 (and any other printing groups) using a sensor 34 reading a mark on plate cylinder 32, for example.

Figure 2:
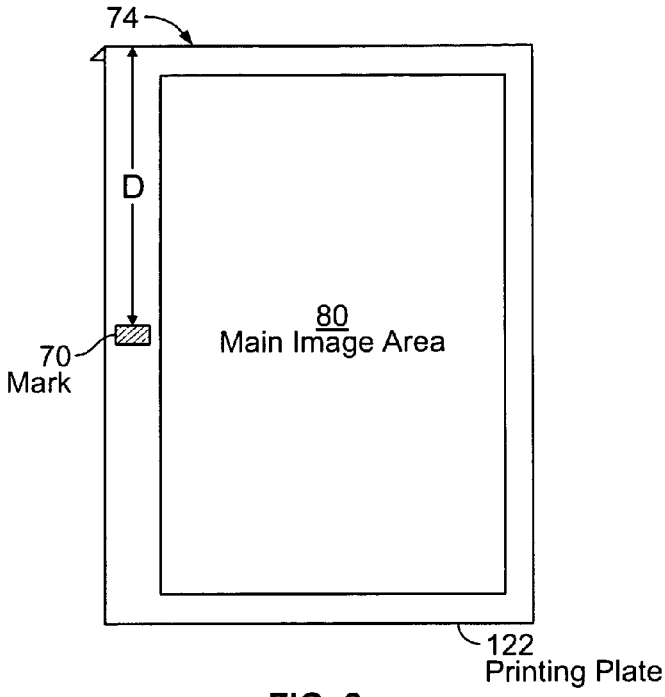
FIG. 2 shows a first embodiment of a printing plate according to the present invention.

FIG. 2 shows an example of a mark 70 on a printing plate 122 to be read by sensors 24 and 34. Mark 70 can be a visible image to the side of a main image area 80, and can be read before or after being inked by the inking devices of the printing press 10. Lead edge 74 (or any other suitable point) of plate 122 can correspond to the zero or other reference position of the encoder for plate cylinder 22D. The top edge of mark 70 can located a distance D from the lead edge 74, this distance D thus determining, when plate 122 is on plate cylinder 22D, the angular position of mark 70. This angular position can coincide for example with the desired preset phase for motor 220 and plate 122.

Figure 3:
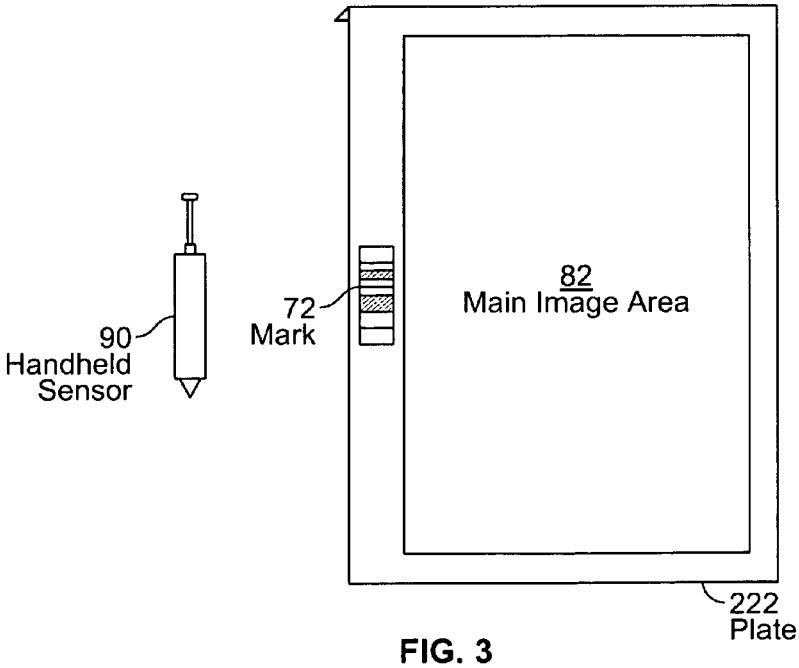
FIG. 3 shows a second embodiment of a printing plate according to the present invention.

FIG. 3 shows an alternate example of mark 72 on a printing plate 222 with a main image area 82. Mark 72 may be for example a bar code containing the desired preset phase information for motor 220. Mark 72 may be read by sensor 24 when on plate 22D, sensor 24 in this case being a barcode reader. Alternately, an operator could scan bar code 72 with a handheld sensor 90, for example, to provide the preset information to controller 200. Mark 72 also could be positioned similarly to mark 70 so that sensor 24 reads its lead edge position, which could provide redundant phase preset information.

Returning to FIG. 1, the initialization process may be described. For example, when an operator receives a new job order for the printing press 10, the desired preset motor phase values may be unknown. The operator can use plate-making equipment 50 to burns marks 70 for the plates for plate cylinders 22D and 32 at a known angular position, for example 0 or 180 degrees. The operator can then run the press with plates attached and adjust the phase angles for motors 220, 230 manually to obtain a proper print-to-cut register for each web 120, 130 for that job with respect to a reference position provided by the folder 40. Sensors 24 (or other sensors) can then read the angular position of the marks 70 with respect to the encoder reference position for each plate cylinder 22D, 32. The particular job may require that the phase for motor 220 be set so that plate cylinder 22D is preset to 23 degrees and that the phase for motor 230 be preset so that plate cylinder 32 starts at 110 degrees. For all future plates for this job, marks 70 can be imaged at 23 degrees and 110 degrees for plates for cylinders 22D and 32, respectively. This data can be stored either in a memory accessible to the controller, 200 or elsewhere, for example on a CD-ROM. The data need only be made accessible to the platemaking equipment controller (which may be controller 200 or a separate controller) before making of the image forms. Once the images are formed, the data is accessible to the controller 200 via marks 70 or 72 and sensors 24, 34.

LIST OF DRAWING NUMBERS

10 printing press
20 first printing group
22A–F plate cylinders
23 blanket cylinder
24 sensor
30 second printing group
32 plate cylinder
34 sensor
40 folder
42 cutting device
50 platemaking equipment
70 mark
72 mark
74 lead edge
80 main image area
82 main image area
90 handheld sensor
120 web
122 printing plate
130 web
140 signatures
200 controller
220 motor
22 plate
230 motor

What is claimed is:

1. A method for presetting motor phase in a web printing press comprising the steps of:

determining a desired preset phase for a motor;

subsequent to the determining step, providing a mark on a first printing form using plate or image making equipment, the plate or image making equipment providing the mark as a function of the determined desired preset phase for a motor driving the first printing form during printing;

reading the mark using a sensor, the sensor having a sensor output; and presetting the phase of the motor as a function of the sensor output.

2. The method as recited in claim 1 wherein the desired preset phase is a function of a physical position of the mark on the first printing form.

3. The method as recited in claim 2 wherein the mark includes information related to the desired preset phase.

4. The method as recited in claim 1 wherein the mark includes information related to the desired preset phase.

5. The method as recited in claim 1 wherein the first printing form is a lithographic printing plate.

6. The method as recited in claim 5 wherein the sensor reads the mark prior to placement of the printing plate on the printing press.

7. The method as recited in claim 1 wherein the mark is located outside a main image area of the printing plate.

8. The method as recited in claim 1 wherein the sensor reads the mark when the first printing form is on the printing press.

9. The method as recited in claim 1 further comprising providing a second mark on a second printing form, the second mark being a function of a desired preset phase for a second motor driving the second printing form during printing, the first and second printing forms printing different webs.

10. The method as recited in claim 1 further including calculating the desired preset phase for a specific job.

11. The method as recited in claim 10 further comprising storing the desired preset phase.

12. The method as recited in claim 1 further comprising measuring a distance of the mark from an edge of the first printing form.

13. The method as recited in claim 1 wherein the mark is a bar code.

14. A web printing press comprising:

plate or image making equipment providing a first mark to a first printing form, the first mark being provided as a function desired preset motor phase information;

a first printing group for printing a first web and having at least one first drive motor and the first printing form, the first printing form having the first mark providing first preset motor phase information for presetting the first drive motor to a first preset phase;

a first sensor for reading the first mark, the first sensor having an output; and a controller for determining the first preset motor phase information as a function of the output of the first sensor and determining the desired preset motor phase information and providing the desired preset motor phase information to the plate or image making equipment.

15. The web printing press as recited in claim 14 further comprising a folder having a cutting device for cutting the web into signatures, the first preset motor phase information being a function of a reference position of the cutting device.

16. The web printing press as recited in claim 14 further including a second printing group for printing a second web and having at least one second drive motor and at least one second printing form, the second printing form having a second mark providing second preset motor phase information for presetting the second drive motor to a second preset phase.

17. The web printing press as recited in claim 16 wherein the controller controls the first and second drive motors.

* * * * *